US007290691B1

(12) United States Patent
Wen

(10) Patent No.: US 7,290,691 B1
(45) Date of Patent: Nov. 6, 2007

(54) PNEUMATIC NAIL GUN

(75) Inventor: Wan-Fu Wen, Taipei Hsien (TW)

(73) Assignee: De Poan Pheumatic Corp., Taipei (TW)

( * ) Notice: Subject to any disclaimer, the term of this patent is extended or adjusted under 35 U.S.C. 154(b) by 57 days.

(21) Appl. No.: 11/551,070

(22) Filed: Oct. 19, 2006

(30) Foreign Application Priority Data

Aug. 30, 2006 (TW) ..... 95132006 A

(51) Int. Cl.
*B25C 1/04* (2006.01)

(52) U.S. Cl. ..... 227/8; 227/130

(58) Field of Classification Search ..... 227/130, 227/8, 136, 10

See application file for complete search history.

(56) References Cited

U.S. PATENT DOCUMENTS 3,190,187 A * 6/1965 Doyle ..... 91/403
3,504,840 A * 4/1970 Wandel et al. ..... 227/130
3,657,968 A * 4/1972 Lange ..... 91/398
3,715,069 A * 2/1973 O'Conner ..... 227/130
4,030,655 A * 6/1977 Rothfuss et al. ..... 227/130
4,448,338 A * 5/1984 Graf et al. ..... 227/8
4,523,646 A * 6/1985 Doyle et al. ..... 173/15
4,909,419 A * 3/1990 Yamada et al. ..... 227/1
5,020,712 A * 6/1991 Monacelli ..... 227/8
6,145,727 A * 11/2000 Mukoyama et al. ..... 227/130
6,164,510 A * 12/2000 Deieso et al. ..... 227/130
6,520,397 B1 * 2/2003 Moeller ..... 227/130

* cited by examiner

*Primary Examiner*—Scott A. Smith

(57) ABSTRACT

A pneumatic nail gun has a gun body having a main air housing; a cylinder fixed in the main air housing; a hitting piston slidably movable in the cylinder; a dish-shaped piston disposed at a top end portion of the cylinder; an upper slidable sleeve valve disposed at a top portion of an out peripheral surface of the cylinder, which is driven to move upward by the high pressure air in the main air housing; and a lower slidable sleeve valve disposed at a lower portion of an outer peripheral surface of the cylinder, which is driven to move downward for guiding the high pressure air into the cylinder for upward deposition of the hitting piston when the upper slidable sleeve valve moves upward, and is driven to upward reposite when the hitting piston moves to its upper dead center.

10 Claims, 11 Drawing Sheets

PNEUMATIC NAIL GUN

BACKGROUND

The present invention relates to a pneumatic nail gun, and particularly to a pneumatic nail gun having an upper slidable sleeve valve and a lower slidable sleeve valve.

The pneumatic nail gun generally utilizes a compressed high pressure air to drive nails to punch, which is a gun-shaped pneumatic tool. The general structure and function of a nail gun is briefly introduced as follows. A nail gun has a gun body, the gun body having a gun handle and a gun head; a fastening cylinder disposed in the gun head; a high-pressure gas pipe coupled to one end of the gun handle, and a high-pressure gas being input and introduced into the cylinder; a piston disposed in the cylinder, the piston connected to a nail shooting mechanism at the external end of the gun head, and the nail shooting mechanism coupled to a nail magazine. When the gun body is triggered, and the piston is pushed downward by the compressed high pressure air such that the nail shooting mechanism can shoot out the nail at the nailing position. In addition, an air chamber is provided at an outer peripheral surface of the cylinder, which receives high pressure air from the cylinder to drive the piston to its original position when the piston moves its lower dead center.

However, the air chamber just can receive the high pressure air when the piston moves downward and can not receive high pressure air during the piston moves upward. Thus, the collection of the high pressure air in the air chamber for upward movement of the piston is limited, and the stability of the upward movement of the piston is lower. Especially, in the process of continuous nail punching, the instability upward movement of the piston lowers the speed and efficiency of nail punching.

For resolving the question, one method of adding the cubage of the air chamber is provided in recently technology. However, the method still is not an ideal resolution.

Accordingly, what is needed is a pneumatic nail gun that can overcome the above-described deficiencies.

BRIEF SUMMARY

A pneumatic nail gun has a gun body, which has a main air housing collecting a compressed high pressure air with a constant pressure, and a trigger at one end of the main air housing driving the high pressure air to shoot a nail; a cylinder fixed in the main air housing; a hitting piston slidably movable in the cylinder; a dish-shaped piston disposed at a top end portion of the cylinder, which is driven to move upward and guides the high pressure air into the cylinder for driving the hitting piston rapidly move downward when the trigger is pressed, and is driven to move downward by the high pressure air in the main air housing for closing the fluid communication into the cylinder when the trigger is released; an upper slidable sleeve valve disposed at a top portion of an out peripheral surface of the cylinder, which is driven to move upward by the high pressure air in the main air housing when the trigger is released; a lower slidable sleeve valve disposed at a lower portion of an outer peripheral surface of the cylinder, which is driven to move downward for guiding the high pressure air into the cylinder for upward deposition of the hitting piston 3 when the upper slidable sleeve valve moves upward, and is driven to upward reposite when the hitting piston moves to its upper dead center, the upper slidable sleeve valve being driven to downward reposite and closing the fluid communication to the lower slidable sleeve valve.

The pneumatic nail gun utilizes the upper and the lower slidable sleeve valves to realize the stably upward movement of the piston through rapidly and continuously guiding the compressed high pressure air into the cylinder in the process of upward deposition of the hitting piston.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
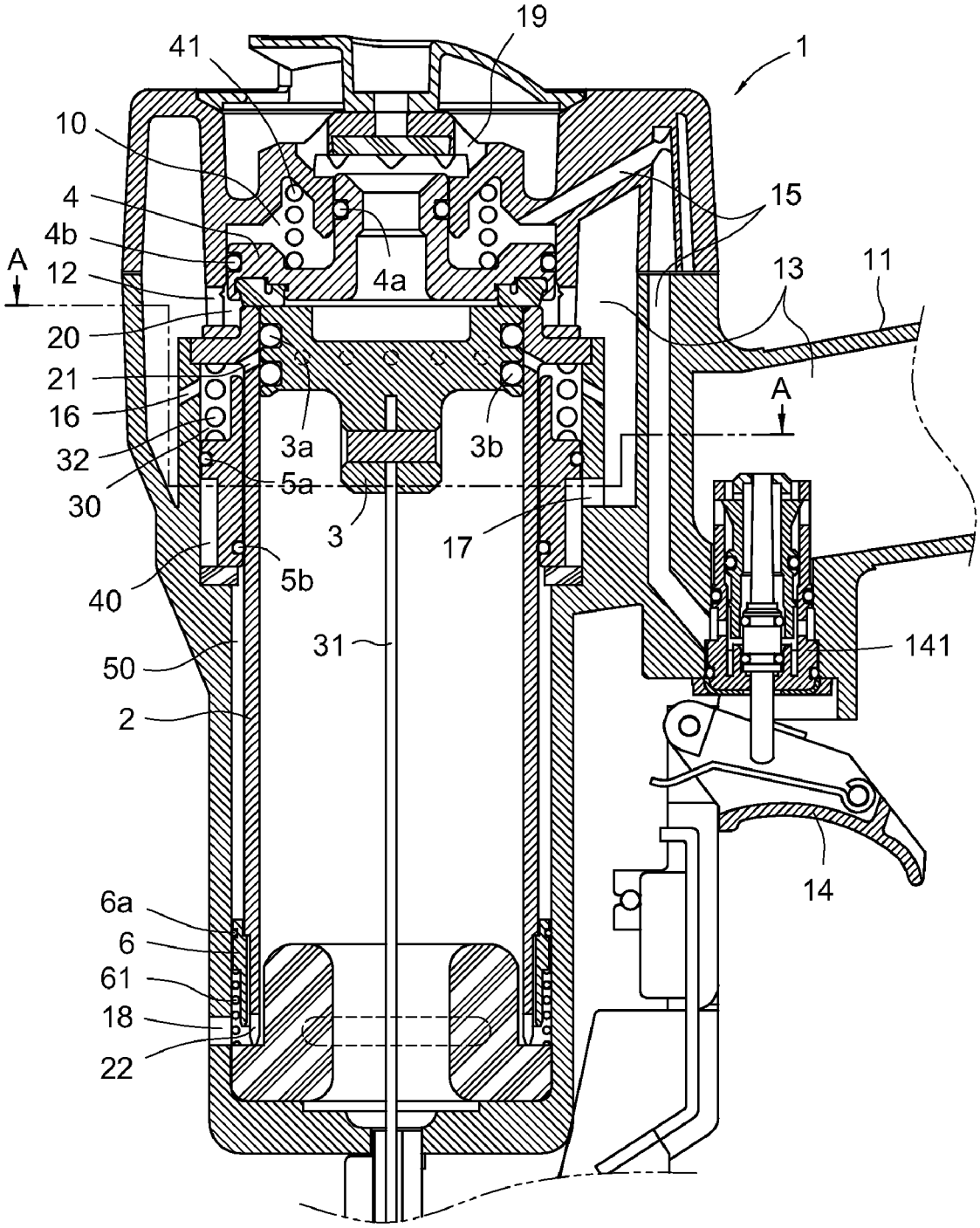
FIG. 1 is a cross-sectional view of a pneumatical nail gun according to a first embodiment of the present invention, the pneumatical nail gun having an upper slidable sleeve valve and a lower slidable sleeve valve.

Referring to FIG. 1, a pneumatic nail gun according to a first embodiment of the present invention is shown. The pneumatic nail gun has a gun body 1, an immovable cylinder 2, a hitting piston 3, a dish-shaped piston 4, an upper slide sleeve valve 5 and a lower slide sleeve valve 6.

Figure 2:
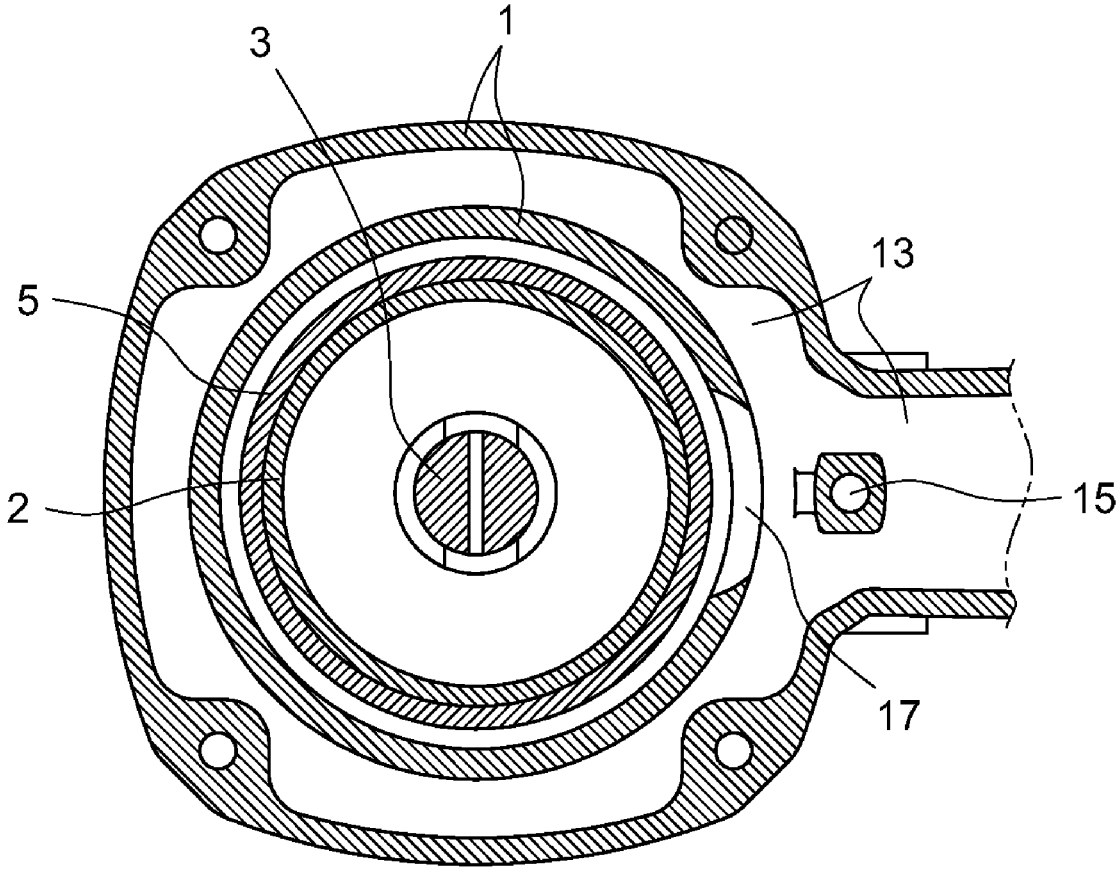
FIG. 2 is a cross-sectional view of the pneumatical nail gun of FIG. 1, taken along a line of A-A of FIG. 1.
Figure 3:
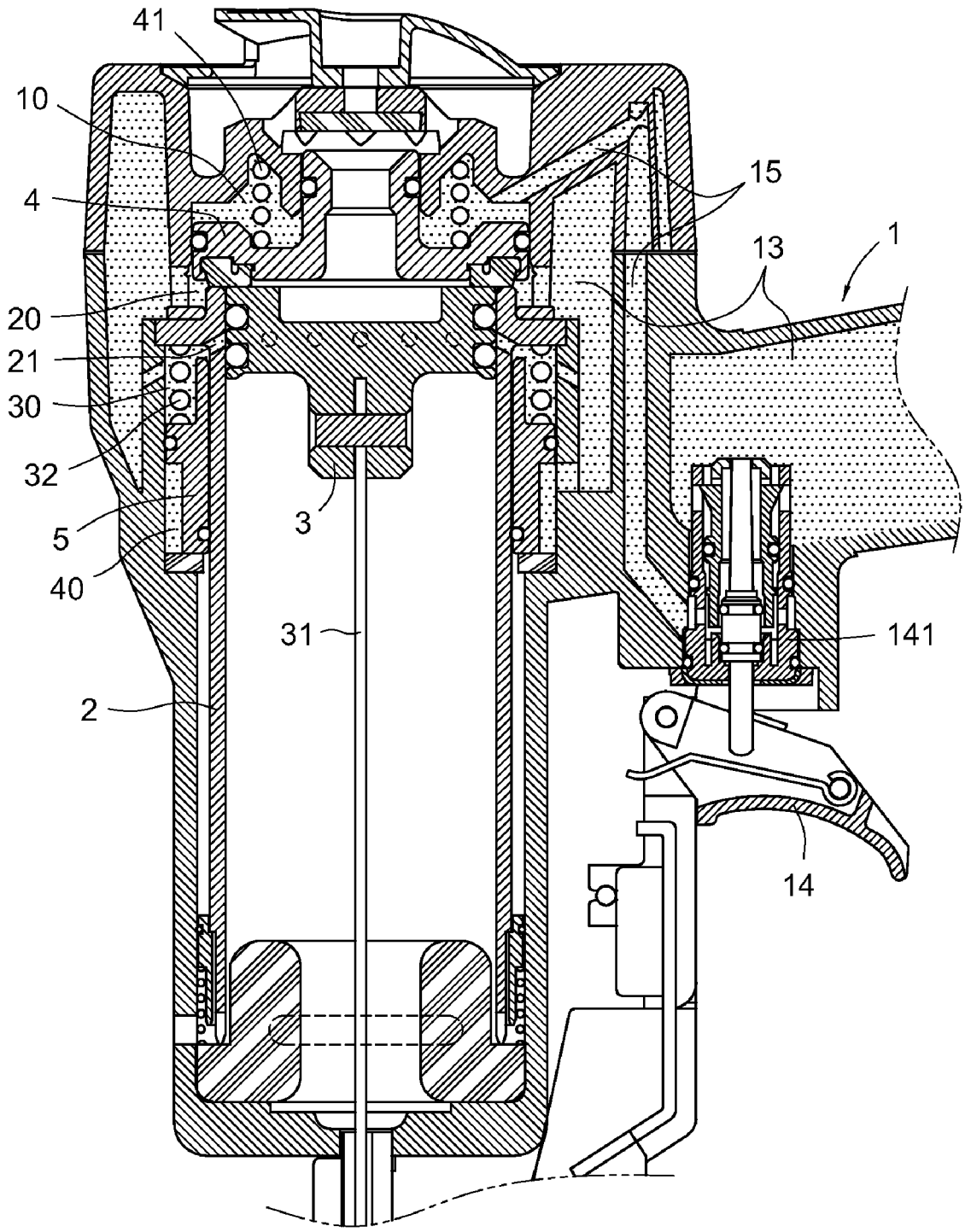
FIG. 3 is a cross-sectional view of the pneumatical nail gun of FIG. 1, showing a state of high pressure air gathered in a main air housing, a first air chamber, a second air chamber, a third air chamber and a fourth air chamber of the pneumatical nail gun.
Figure 4:
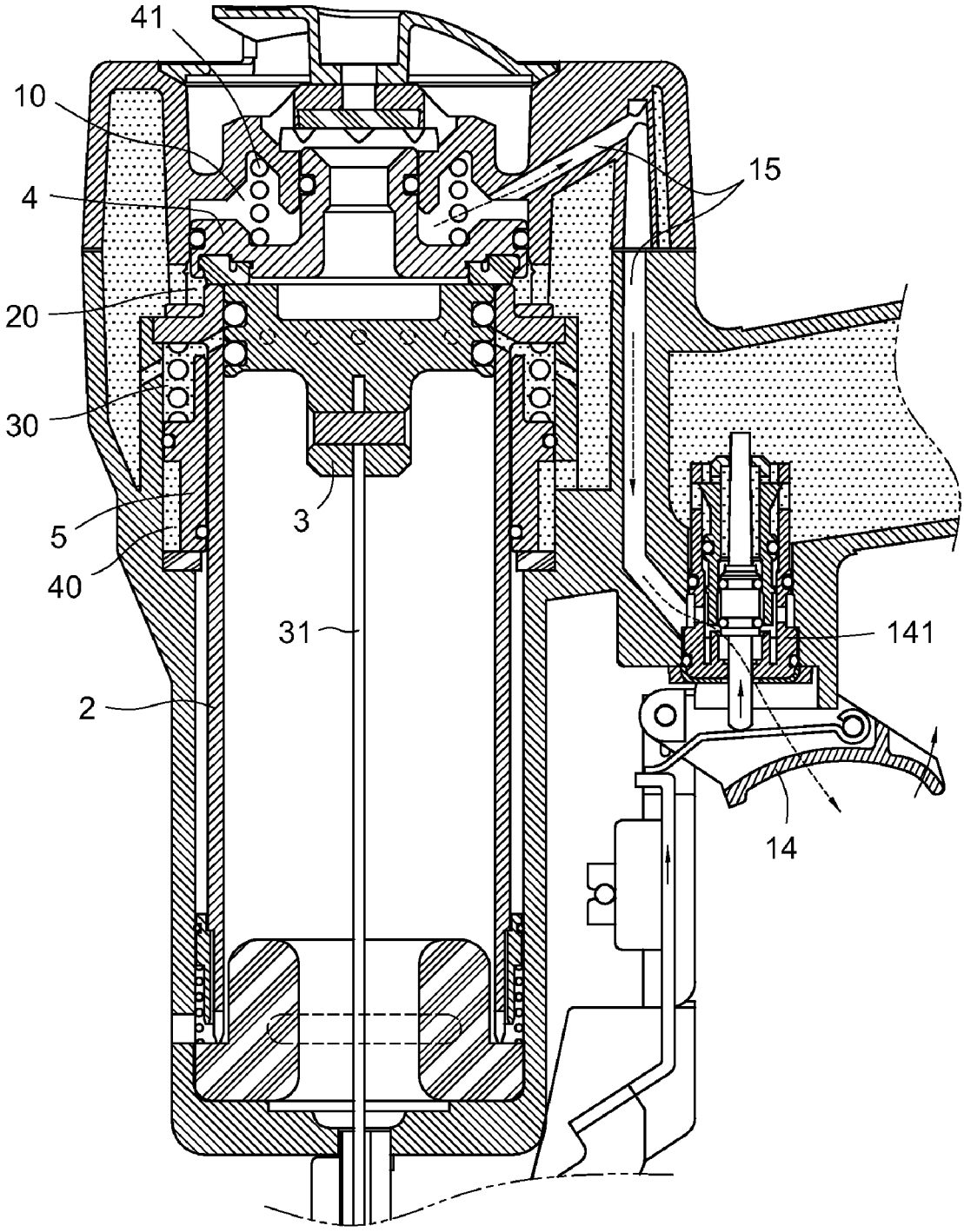
FIG. 4 shows a cross-sectional view of the pneumatical nail gun of FIG. 1, showing a state of the high pressure air being exhausted from the first air chamber, when a trigger is pressed.

The gun body 1 has a main air housing 13 formed in a gun handle and gun head, which communicate with each other, for coutinuously collecting a compressed high-pressure air therein (as shown in FIG. 2). The gun body 1 further has a trigger 14 at one end of the main air housing 13, and a trigger valve 141 is disposed in the main air housing 13 to be operated by the manipulation of the trigger 14. The trigger valve 141 provides a first valve position by the non-manipulation to the trigger 14 to fluidly communicate the main air housing 13 and a first air chamber 10 in the gun body 1 with the high pressure air, and provides a second valve position by manipulation to the trigger 14 to shut off the fluid communication between the main air housing 13 and the first air chamber 10 (as shown in FIG. 3 and FIG. 4).

The cylinder 2 is fixed in the gun body 1. The hitting piston 3 is slidably and reciprocally movably disposed in the cylinder 2, and a driver blade 31 extends from a lower end surface (not labeled) of the hitting piston 3. A tip end of the driver blade 31 can protrude out of the gun body 1 for punching against a nail in accordance with a downward movement of the hitting piston 3. In addition, two annular ring grooves (not labeled) are formed in an outer peripheral surface of the hitting piston 3, and two O-rings 3*a*, 3*b* are assembled in the two ring grooves, respectively. The two O-rings 3*a*, 3*b* are made from a resilient or elastic material such as rubber to provide sealing contact between the cylinder 2 and the hitting piston 3.

Figure 6:
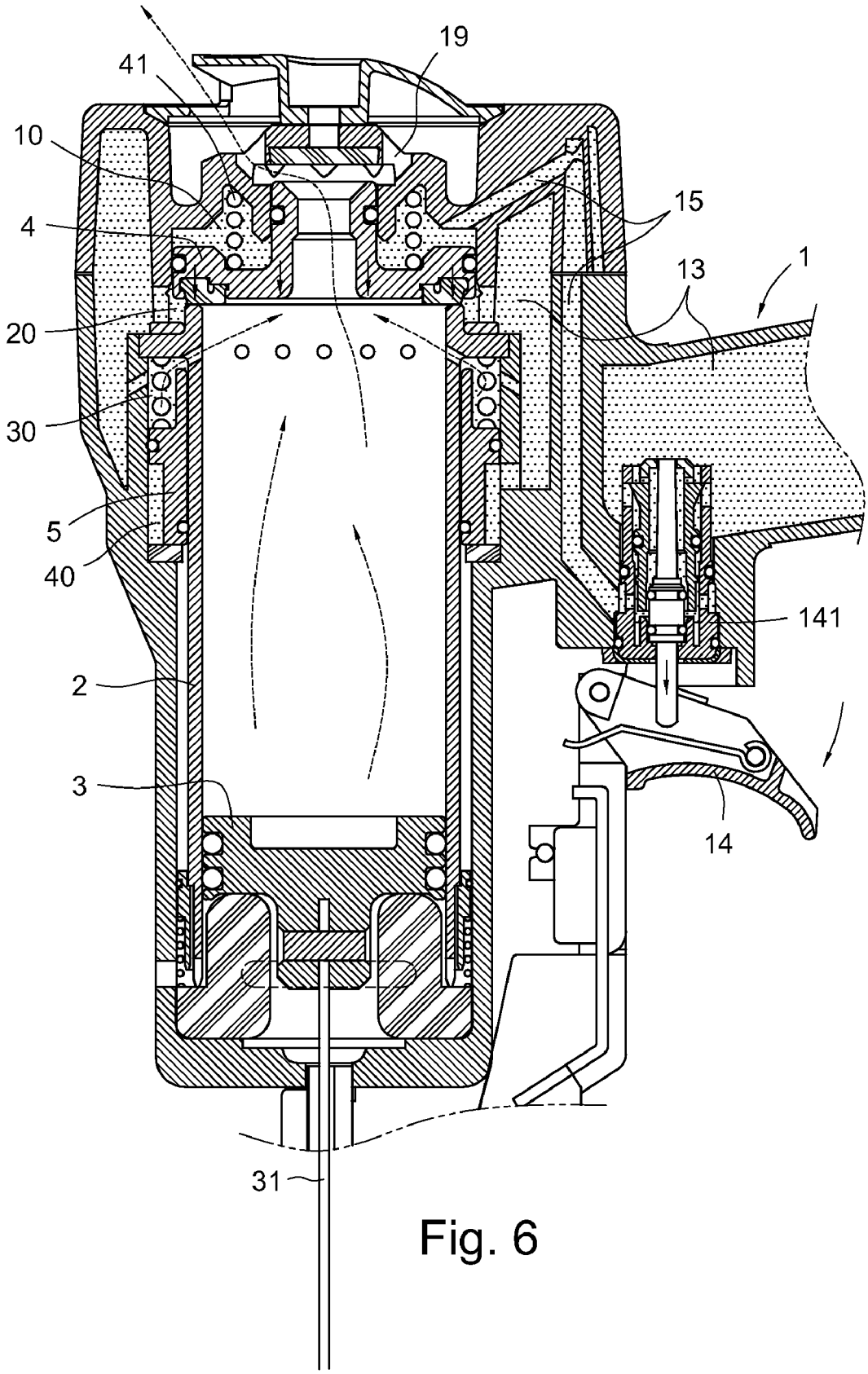
FIG. 6 shows a cross-sectional view of the pneumatical nail gun of FIG. 1, showing a state of the high pressure air re-collecting into the first air chamber for downwardly repositing the dish-shaped piston, when the trigger is released, and the high pressure air in the third air chamber being discharged.

The upper slidable sleeve valve 5 is disposed at a top portion of an out peripheral surface of the cylinder 2, which further respectively provides at least one air-tight ring 5*a*, 5*b* at its inner sidewall and outer sidewall, for respectively realizing sealing contact between the upper slidable sleeve valve 5 and an inner sidewall of the gun body 1, and between the upper slidable sleeve valve 5 and an outer sidewall of the cylinder 2. When the trigger 14 is released (as shown in FIG. 6), the upper slidable sleeve valve 5 is driven to move upward by the high pressure air in the main air housing 13.

The lower slidable sleeve valve 6 is disposed at a lower portion of an outer peripheral surface of the cylinder 2, which provides at least one air-tight ring 6*a* between the outer sidewall thereof and an inner sidewall of the gun body 1. When the upper slidable sleeve valve 5 moves upward, the lower slidable sleeve valve 6 is driven to move downward for guiding the high pressure air into the cylinder 2 and driving the hitting piston 3 to move upward. When the hitting piston 3 moves upward for reposition, the upper slidable sleeve valve 5 is driven to move downward for reposition and closing the fluid communication to through the lower slidable sleeve valve 6 to the cylinder 2.

Figure 5:
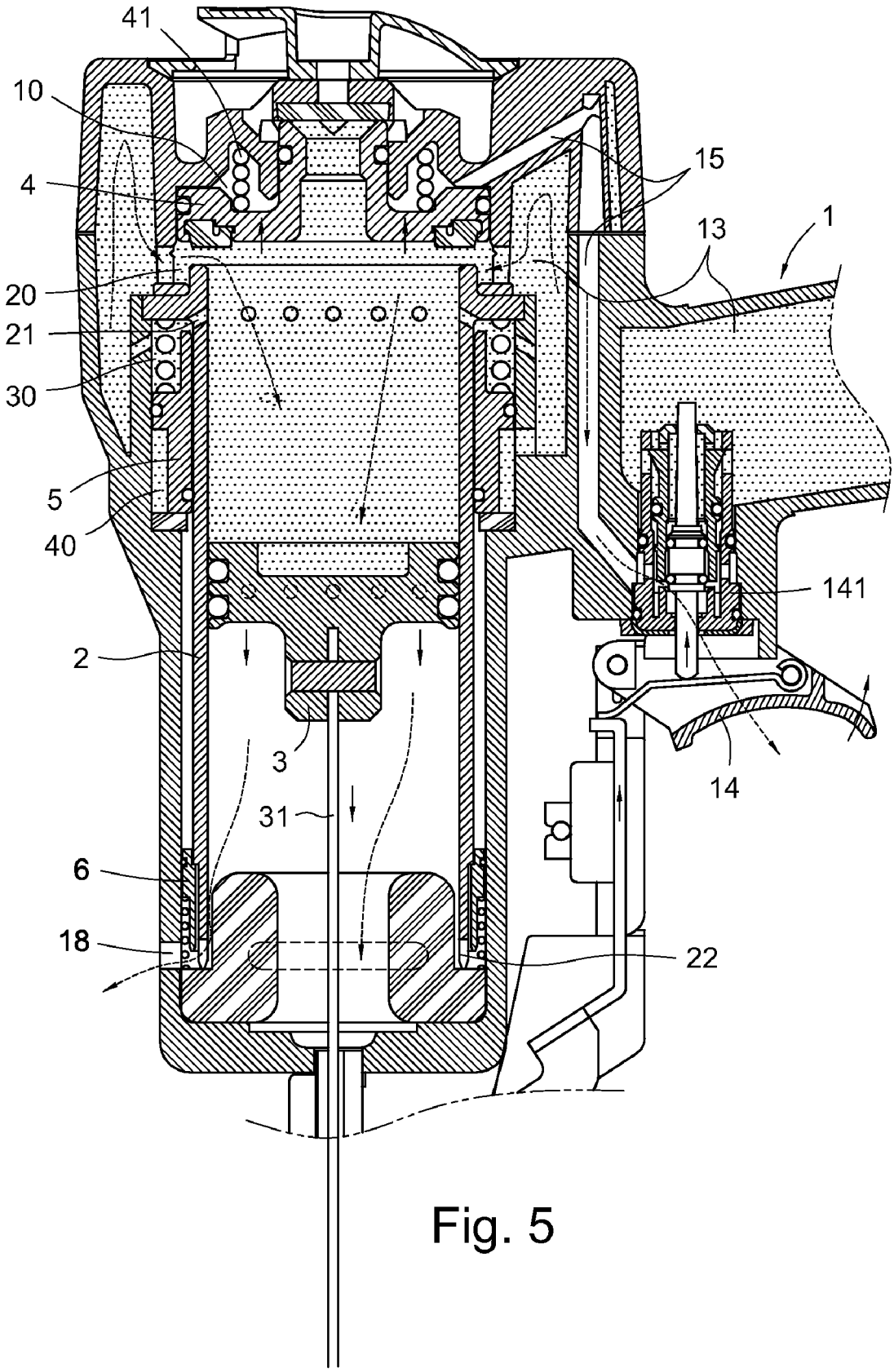
FIG. 5 shows a cross-sectional view of the pneumatical nail gun of FIG. 1, showing a state after the trigger is pressed, wherein the dish-shaped piston is driven to move upward by the high pressure air and the hitting piston moves downward to a lower dead center.

The first air chamber 10 is formed between a top end of the dish-shaped piston 4 and an inner peripheral surface of the gun body 1. Before the trigger 14 is pressed (as shown in FIG. 3), the first air chamber 10 fluidly communicate with the main air housing 13 through a trigger passage 15 formed in the gun body 1, wherein the compressed high-pressure air in the main air housing 13 flows into the first air chamber 10 and the high-pressure air drives the dish-shaped piston 4 to move downward. When the trigger 14 is pressed (as shown in FIG. 4 & FIG. 5), the trigger valve 141 shut off the trigger passage 15 between the main air housing 13 and the first air chamber 10 and the compressed high-pressure air in the first air chamber 10 is discharged therefrom.

Two O-rings 4*a*, 4*b* are assembled in an inner ring groove (not labeled) and an outer ring groove (not labeled) of the dish-shaped piston 4, respectively, to provide air-sealing of the first air chamber 10.

A second air chamber 20 is formed between the dish-shaped piston 4 and a top portion of an outer peripheral surface of the cylinder 2. The second air chamber 20 fluidly communicates with the main air housing 13 through a plurality of through holes 12 formed at the gun body 1 for guiding the compressed high-pressure air in the main air housing 13 into the second air chamber 20. The high-pressure air in the second air chamber 20 drives the dish-shaped piston 4 to move upward when the high-pressure air in the first air chamber 10 is discharged (as shown in FIG. 4 & FIG. 5).

A top spring 41 is disposed in the first air chamber 10. When the first air chamber 10 is charged with the high-pressure air (as shown in FIG. 3 & FIG. 6), a sum of an elastic deformation force of the top spring 41 and a pressure thrust of the high-pressure air in the first air chamber 10 is larger than a pressure thrust of the high-pressure air in the second air chamber 20, which assures the dish-shaped piston 4 stably downward movement. When the high-pressure air in the first air chamber 10 is discharged therefrom (as shown in FIG. 4 & FIG. 5), the single elastic deformation force of the top spring 41 is smaller than a pressure thrust of the high-pressure air in the second air chamber 20, which assures the dish-shaped piston 4 stably upward movement and guides the high pressure air in the main air housing 13 into the cylinder 2 to drive the hitting piston move downward.

The pneumatic air gun further has a third air chamber 30, a plurality of top vent holes 21, a fourth air chamber 40 and a plurality of bottom vent holes 22.

The third air chamber 30 is positioned among the cylinder 2, the upper slidable sleeve valve 5 and the inner peripheral surface (not labeled) of the gun body 1. The gun body 1 has a plurality of second through holes 16 fluidly communicating with the main air housing 13 for guiding compressed high-pressure air into the third air chamber 30. The high-pressure air in the third air chamber 30 drives the upper slidable sleeve valve 5 to move downward to its lower dead center when the dish-shaped piston 4 moves downward for reposition and the hitting piston 3 moves upward for reposition (as shown in FIG. 3).

The plurality of top vent holes 21 is formed at a top portion of the cylinder 2, which communicates the third air chamber 30 and the cylinder 2. The top vent holes 21 have a fluid communication area larger than that of the second through holes 16. Thus, when the upper slidable sleeve valve 5 and the dish-shaped piston 4 move downward, the high pressure air of the third air chamber 30 through the second through holes 16 can be quickly discharged to the cylinder 2 by the top vent holes 21. And, when the hitting piston 3 moves upward for reposition, the plurality of top vent holes 21 can quickly close the fluidly communication from the third air chamber 30 to the cylinder 2.

Figure 7:
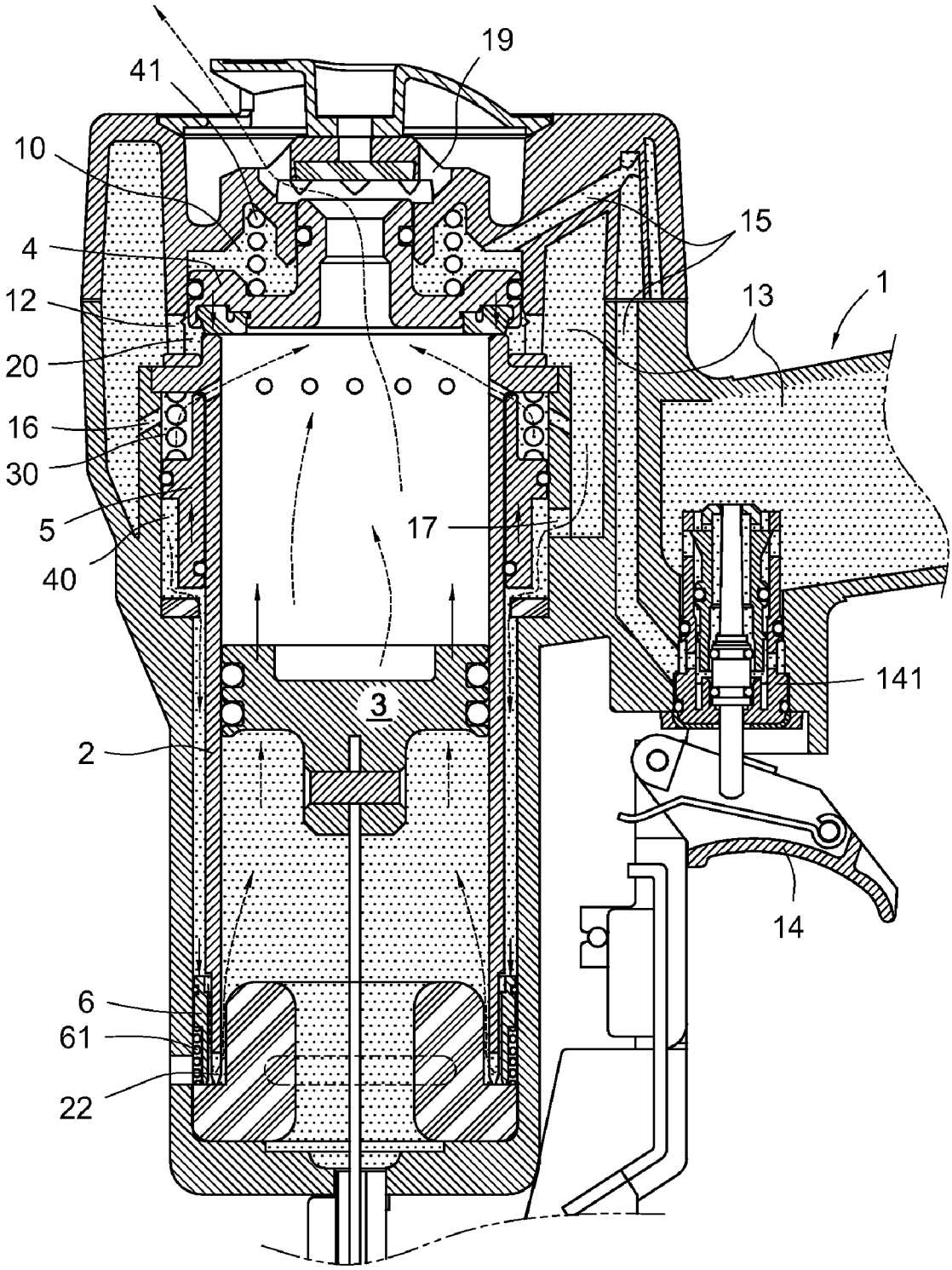
FIG. 7 shows a cross-sectional view of the pneumatical nail gun of FIG. 1, showing a state after the trigger is released, wherein the upper slidable sleeve valve moves upwards and the high pressure air is guided into the fourth air chamber to drive the lower sleeve valve move downwardly for continuously guiding the high pressure air into the cylinder to drive the hitting piston move upwardly.

A fourth air chamber 40 is formed between an inner peripheral surface of the gun body 1 and an outer peripheral surface of the upper slideable sleeve valve 5. The fourth air chamber 40 fluid communicates with the main air housing 13 to guide compressed high-pressure air in the main air housing 13 to the fourth air chamber 40 through at least one third through hole 17 formed in the gun body 1 (as shown in FIG. 2 & FIG. 3). The high pressure air in the fourth air chamber 40 drives the upper slidable sleeve valve 5 to move upward when the high-pressure air in the third air chamber 30 is discharged, and the lower slidable sleeve valve 6 to move downward (as shown in FIG. 6 & FIG. 7).

A plurality of bottom vent holes 22 is positioned at a bottom end portion of the cylinder 2. When the lower sleeve valve 6 move downward, the bottom vent holes 22 guides the high-pressure air in the fourth air chamber 40 into the cylinder 2 to drive the hitting piston 3 to upward deposite (as shown in FIG. 7).

In addition, an intermediate spring 32 can be provided in the third air chamber 30 (as shown in FIG. 3). A sum of an elastic deformation force of the intermediate spring 32 and a pressure thrust of the high-pressure air in the third air chamber 30 is larger than a pressure thrust of the high-pressure air in the fourth air chamber 40, and the single elastic deformation force of the intermediate spring 32 is smaller than a pressure thrust of the high-pressure air in the fourth air chamber 40, which assures the upper sleeve valve 5 downward deposition when the third and the fourth air chambers 30, 40 are charged with high pressure air therein, and assures the upper sleeve valve 5 upward deposition when the high-pressure air in the third air chamber 30 is discharged therefrom (as shown in FIG. 7).

In alternative modification, the pneumatic nail gun can further provide a ring groove 50 (as shown in FIG. 1) defining by the outer peripheral surface of the cylinder 2, the upper slidable sleeve valve 5, the lower slidable sleeve valve 6, and the gun body 1, which can drive the lower slidable sleeve valve 6 to move downward when the high pressure air in the fourth air chamber 40 is guided therein.

In another alternative modification, the pneumatic nail gun can further provide a bottom spring 61 (as shown in FIG. 3) used to push the lower slidable sleeve valve 6, which has an elastic deformation force less than a pressure thrust of the high-pressure air in the fourth air chamber 40 or a pressure thrust of the high-pressure air in the ring groove 50 guided from the fourth air chamber 40. Thus, the lower slidable sleeve valve 6 can be driven to move downward by the high pressure air, when the upper slidabe sleeve valve 5 move upward; and can be driven to upward deposite when the upper slidabe sleeve valve 5 downward deposite.

Figure 8:
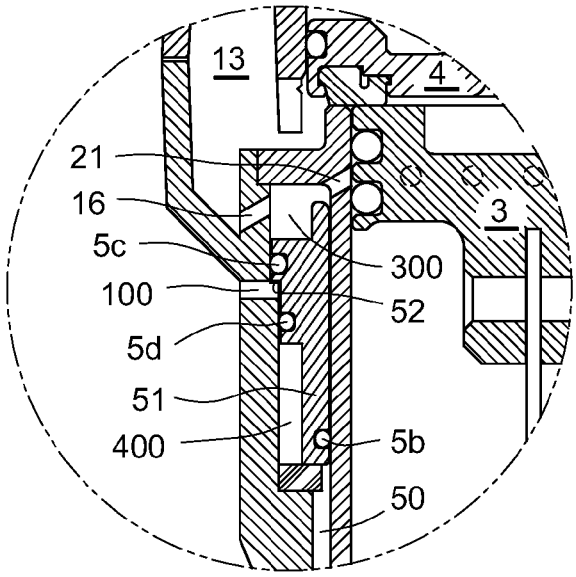
FIG. 8 is a cross-sectional view of a part of a pneumatical nail gun according to a second embodiment of the present invention, showing a step formed at a peripheral surface of an upper slidable sleeve valve.
Figure 9:
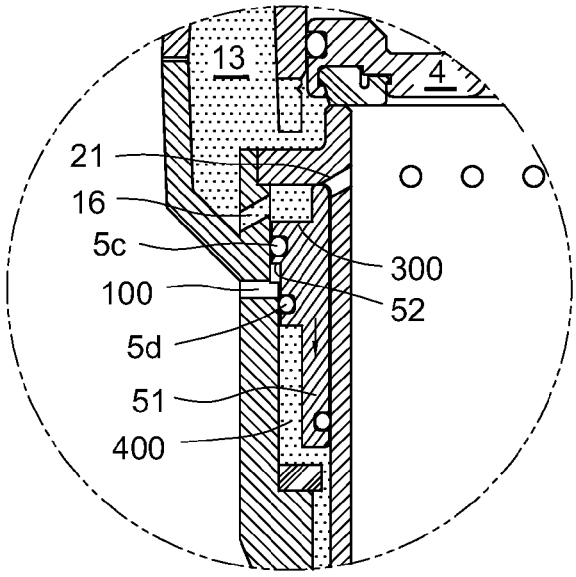
FIG. 9 and FIG. 10 show an operation state of the pneumatical nail gun of FIG. 8, showing the upper sleeve valve rapidly downward reposited through the pressure thrust of the high pressure air in a third air chamber larger than that in a fourth air chamber.
Figure 10:
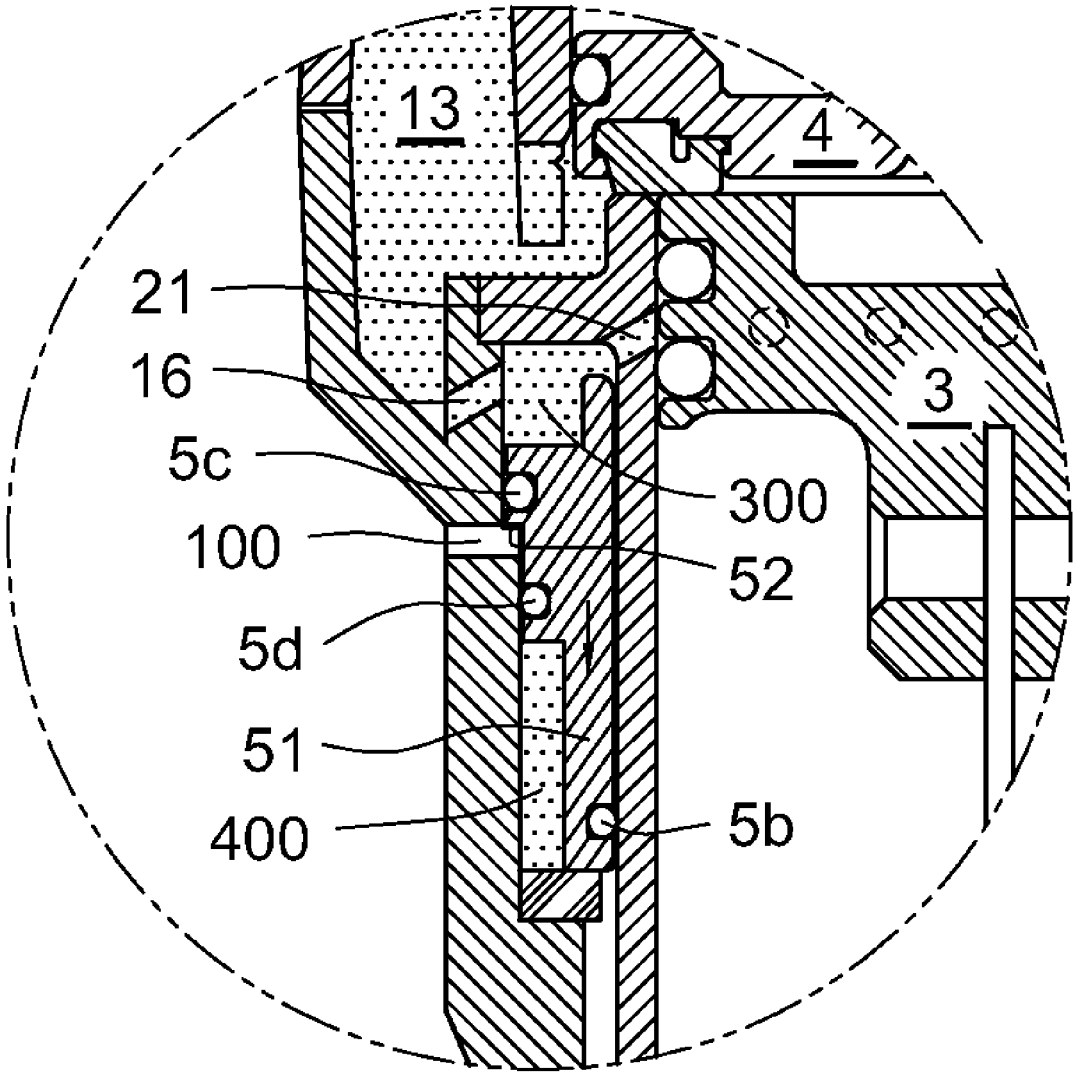

Referring to FIG. 8, a pneumatic nail gun according to a second embodiment of the present invention is shown. The pneumatic nail gun does not have the intermediate spring 32 in the first embodiment, which can provide a step 52 at an peripheral surface of an upper slidable sleeve valve 51, two annular ring grooves (not labeled) formed in an outer peripheral surface of the upper slidable sleeve valve 51, respectively at an upper side and a lower side of the step 52, and two air-tight rings 5*c*, 5*d* assembled in the two ring grooves, respectively. In addition, a gun body has an exhausting hole 100 between the two air-tight rings 5*c*, 5*d*. Thus, when the upper slidable sleeve valve 51 moves downward for deposition, the step 52 can decrease the forcing area and the pressure thrust of a high-pressure air in the fourth air chamber 400 and realizes the pressure thrust of a high-pressure air in the third air chamber 300 being larger than that of the high-pressure air in the fourth air chamber 400, which assures the upper sleeve valve 51 downward deposition when the third and the fourth air chambers 300, 400 are charged with high pressure air therein, and assures the upper sleeve valve 51 upward deposition when the high-pressure air in the third air chamber 300 is discharged therefrom (as shown in FIG. 9 & FIG. 10). Thus, the intermediate spring 32 can be omitted and the cost can be lowered.

In operation, before the trigger 14 is manipulated as shown in FIG. 3, compressed air in the main air housing 13 is applied to the first air chamber 10 through the trigger valve 141 and trigger passage 15, and to the second, third, and fourth air chambers 20, 30, 40 through the first through holes 12, the second through holes 16, and the third through holes 17, respectively. Therefore, the high-pressure air in the first air chamber 10 and the top spring 41 drive the dish-shaped piston 4 to move to its lower dead center to close the top end portion of the cylinder 2, and the high-pressure air in the third air chamber 30 or combined with the intermediate spring 32 drive the upper slidable sleeve valve 5 to move to its lower dead center and closes the fluidly communication between the fourth air chamber 40 and the ring groove 50. At the same time, the hitting piston 3 closes the fluid communication between the cylinder 2 and the top vent holes 21, and the lower slidable sleeve valve 6 is driven to move upward to a dead center by an elastic deformation force of the bottom spring 61.

When the trigger 14 is pulled as shown in FIG. 4, the trigger valve 141 closes the fluid communication between the main air housing 13 and the trigger passage 15. Compressed high-pressure air in the first air chamber 10 is discharged to the atmosphere, so that high-pressure air in the second air chamber 20 drives the dish-shaped piston 4 to move to its upper dead center, which opens the fluid communication of the top portion of the second air chamber 20, and introduces high-pressure air into the cylinder 2, applied to the hitting piston 3. Thus, the hitting piston 3 rapidly moves toward the nail. In addition, at least one bottom exhausting hole 18 formed at a bottom portion of the gun body 1 is opened for discharging residual air under the hitting piston 3 to an atmosphere, and the top vent holes 21 opens for downward movement of the hitting piston 3.

Then, when the user releases the trigger 14 as shown in FIG. 6, the trigger valve 141 returns to the original open state so that the first air chamber 10 re-collects high-pressure air. Thus, the dish-shaped piston 4 moves downward to return to the original state, and closes the air communication from the second air chamber 20 to the cylinder 2. Before the hitting piston 3 moves upward to its upper dead center, the high-pressure air in the third air chamber 30 and in the cylinder above the hitting piston 3 can be exhausted into the atmosphere, and the upper sleeve valve 5 is driven to move upward by the high-pressure air in the fourth air chamber 40, and the lower sleeve valve 6 is driven to move downward to close the bottom exhausting holes 18 by the high-pressure air in the fourth air chamber 40 or in the ring groove 50. Thus, the fluid communication between the bottom vent holes 22 and the fourth air chamber 40 is opened, and the high pressure air in the fourth air chamber 40 is guided into the bottom region of the cylinder 2 to stably drive the hitting piston 3 to move upward. At this time, the high pressure air remaining in the upper layer of the hitting piston 3 is discharged through the top exhausting hole 19.

When the hitting piston 3 is moved to its upper dead center, the top vent holes 21 is closed, the high pressure air in the third air chamber 30 drives the upper sleeve valve 5 to move downward to its original state, and the fluid communication from the fourth air chamber 40 to the lower sleeve valve 6 is closed, and the lower sleeve valve 6 upward moves for depositing. Thus, a single shot cycle is terminated.

Therefore, from above description, it is known that in the above embodiment of the present invention, the pneumatic nail gun utilizes the upper and the lower slidable sleeve valves 5, 6 to realize the stably upward movement of the piston 3 through rapidly and continuously guiding the compressed high pressure air into the cylinder 2 in the process of upward deposition of the hitting piston 3.

Figure 11:
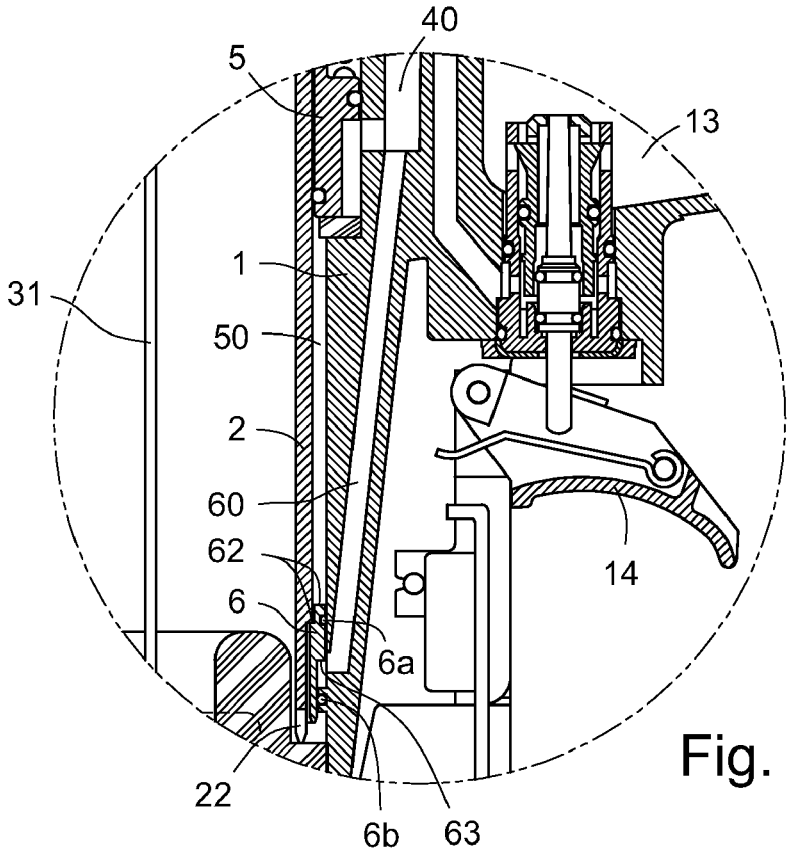
FIG. 11 is a cross-sectional view of a part of a pneumatical nail gun according to a third embodiment of the present invention, showing an upper step and a lower step formed at a peripheral surface of a lower slidable sleeve valve.
Figure 12:
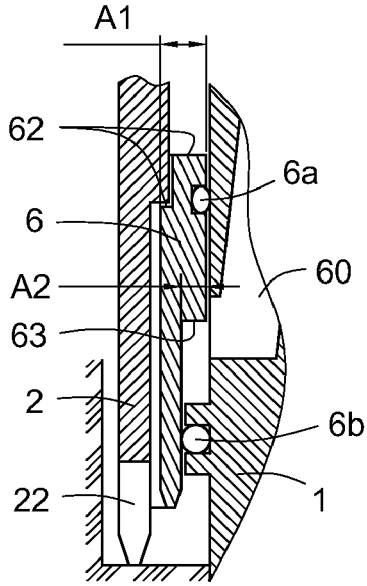
FIG. 12 shows a partly enlarged view of the lower slidable sleeve valve, showing the upper step having a larger forcing area than that of the lower step.
Figure 13:
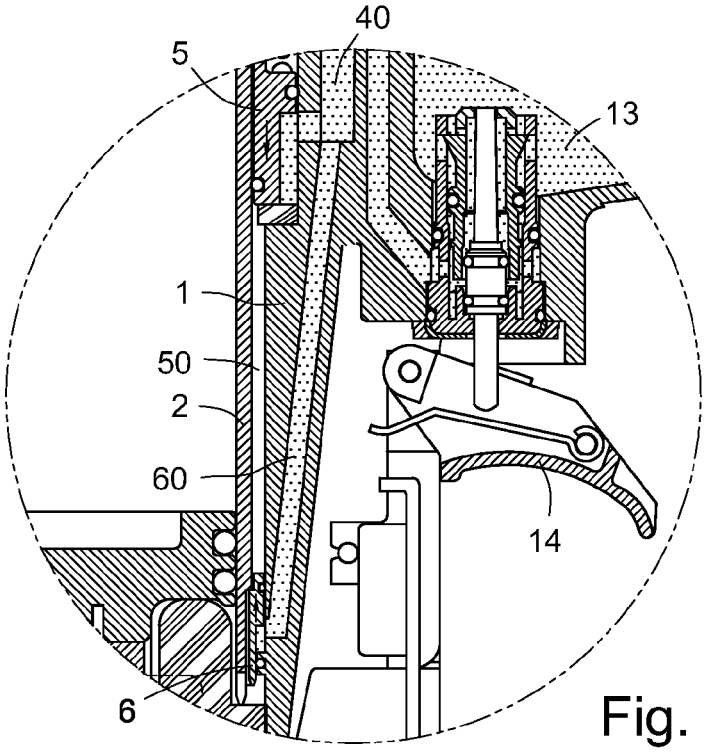
FIG. 13 and FIG. 14 show an operation state of the pneumatical nail gun of FIG. 11, showing the lower sleeve valve rapidly downward moved and upward reposited.
Figure 14:
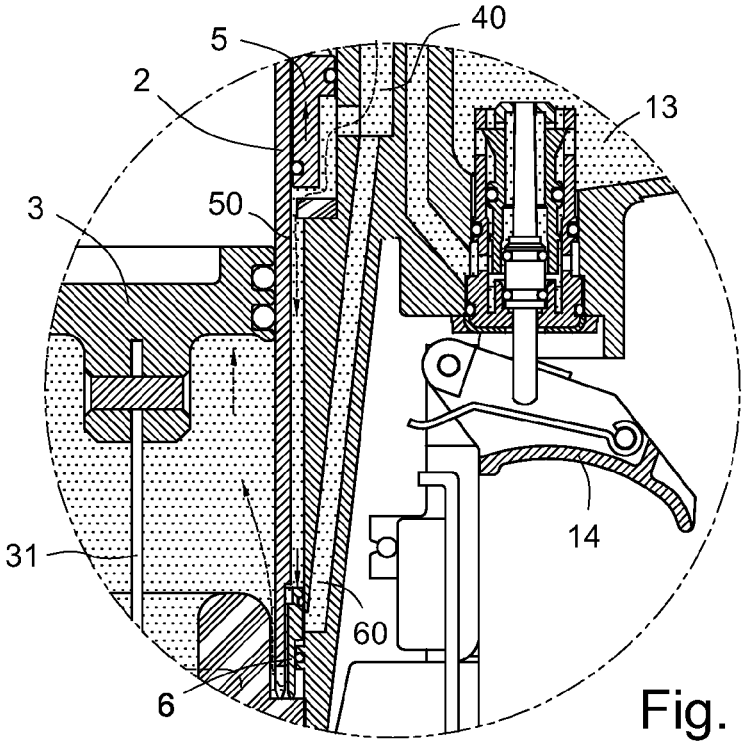

According to a pneumatic nail gun of third embodiment, a lower slidable sleeve valves 6 can utilize at least one upper step 62 formed at a top portion thereof and a lower step 63 formed at a lower portion thereof to replace the spring (as shown in FIG. 11). The upper step 62 has a forcing area A1 larger than that of a forcing area A2 of the lower step 63 (as shown in FIG. 12). The upper step 62 are pushed by the high pressure air from the fourth air chamber 40 or from the ring groove 50 which guides the high pressure air from the fourth air chamber 40. The lower step 63 are pushed by the high pressure air from a main air passage 60 formed in the gun body 1, which guides the high pressure air in the fourth air chamber 40. The lower slidable sleeve valve 6 further provides two air-tight rings 6*a*, 6*b* between its outer peripheral surface and the inner surface of the gun body 1. The lower step 63 and an entrance of the main air passage 60 are disposed between the two air-tight rings 6*a*, 6*b*. Thus, when the upper slidable sleeve valve 5 moves downward for deposition (as shown in FIG. 13), the upper step 62 doesn't receive any one pressure thrust of the high-pressure air, and the lower step 63 is pushed by the high-pressure air from the main air passage 60, which assures the lower slidable sleeve valve 6 moves upwardly. When the upper slidable sleeve valve 5 moves upward (as shown in FIG. 14), the upper step 62 is pushed by the high-pressure air from the fourth air chamber 40 (or the ring groove 50). Because the forcing area A1 of the upper step 62 is larger than that of the lower step 63, the pressure thrust loaded at the upper step 62 is larger than that at the lower step 63, which assures the lower slidable sleeve valve 6 moves downwardly. Thus, the bottom spring 61 (as shown in FIG. 3) can be omitted and the cost can be lowered.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic nail gun comprising:

a gun body, which has a main air housing collecting a compressed high pressure air with a constant pressure, and a trigger at one end of the main air housing driving the high pressure air to shoot a nail;

a cylinder fixed in the main air housing;

a hitting piston slidably movable in the cylinder;

a dish-shaped piston disposed at a top end portion of the cylinder, which is driven to move upward and guide the high pressure air into the cylinder for driving the hitting piston to rapidly move downward when the trigger is pressed, and is driven to move downward by the high pressure air in the main air house for closing the fluid communication into the cylinder when the trigger is released;

an upper slidable sleeve valve disposed at a top portion of an outer peripheral surface of the cylinder, which is driven to move upward by the high pressure air in the main air housing when the trigger is released;

a lower slidable sleeve valve disposed at a lower portion of an outer peripheral surface of the cylinder, which is driven to move downward for guiding the high pressure air into the cylinder for upward deposition of the hitting piston when the upper slidable sleeve valve moves upward, and is driven upward when the hitting piston moves to its upper dead center, the upper slidable sleeve valve being driven to downward reposite and closing the fluid communication to the lower slidable sleeve valve.

2. The pneumatic nail gun as claimed in claim 1, further comprising:

a first air chamber formed between a top end of the dish-shaped piston and an inner peripheral surface of the gun body; which receives the high pressure air from the main air housing when the trigger is released, and exhausts the high pressure air when the trigger is pressed;

a second air chamber formed between the dish-shaped piston and a top portion of an outer peripheral surface of the cylinder, which receives the high pressure air from the main air housing and drives the dish-shaped piston to move upward when the high-pressure air in the first air chamber is discharged.

3. The pneumatic nail gun as claimed in claim 2, wherein a top spring is disposed in the first air chamber, a sum of an elastic deformation force of the top spring and a pressure thrust of the high-pressure air in the first air chamber being larger than a pressure thrust of the high-pressure air in the second air chamber, and an elastic deformation force of the top spring being smaller than the pressure thrust of the high-pressure air in the second air chamber.

4. The pneumatic nail gun as claimed in claim 1, further comprising:

a third air chamber formed among the cylinder, the upper slidable sleeve valve and the inner peripheral surface of the gun body, which fluidly communicates with the main air housing through a first through hole at the gun body, the high-pressure air therein driving the upper slidable sleeve valve to move downward when the dish-shaped piston moves downward and the hitting piston moves upward;

a plurality of top vent holes formed at a top portion of the cylinder, which communicates the third air chamber and the cylinder, and guides the high pressure air to discharge into the cylinder when the upper sleeve valve and the dish-shaped piston move downward, and closes the fluid communication from the third air chamber to the cylinder when the upper slidable sleeve valve moves downward and the hitting piston moves upward;

a fourth air chamber formed between an inner peripheral surface of the gun body and an outer peripheral surface of the upper slideable sleeve valve, which guides compressed high-pressure air in the main air housing to the fourth air chamber through at least one second through hole formed in the gun body, and drives the upper slidable sleeve valve to move upward when the high-pressure air in the third air chamber is discharged; and a plurality of bottom vent holes positioned at a bottom end portion of the cylinder, which guides the high-pressure air in the fourth air chamber into the cylinder to drive the hitting piston to upwardly move, when the lower sleeve valve moves downward.

5. The pneumatic nail gun as claimed in claim 4, wherein an intermediate spring is provided in the third air chamber, a sum of an elastic deformation force of the intermediate spring and a pressure thrust of the high-pressure air in the third air chamber being larger than a pressure thrust of the high-pressure air in the fourth air chamber, and the elastic deformation force of the intermediate spring being smaller than a pressure thrust of the high-pressure air in the fourth air chamber.

6. The pneumatic nail gun as claimed in claim 4, further comprising a step at a peripheral surface of an upper slidable sleeve valve, two air-tight rings assembled in an outer peripheral surface of the upper slidable sleeve valve, respectively, and an exhausting hole at the gun body between the two air-tight rings for decreasing a force acting area and a pressure thrust of a high-pressure air in the fourth air chamber.

7. The pneumatic nail gun as claimed in claim 4, further comprising a ring groove defined by the outer peripheral surface of the cylinder, the upper slidable sleeve valve, the lower slidable sleeve valve, and the gun body, which drives the lower slidable sleeve valve to move downward when the high pressure air in the fourth air chamber is guided therein.

8. The pneumatic nail gun as claimed in claim 4, further comprising a bottom spring used to push the lower slidable sleeve valve, which has an elastic deformation force less than a pressure thrust of the high-pressure air in the fourth air chamber guided from the fourth air chamber.

9. The pneumatic nail gun as claimed in claim 4, wherein the lower slidable sleeve valves has at least one upper step formed at a top portion thereof and a lower step formed at a lower portion thereof, the upper step having a force acting area larger than that of a force acting area of the lower step, the upper step being pushed by the high pressure air from the fourth air chamber, the lower step being pushed by the high pressure air from a main air passage formed in the gun body, which guides the high pressure air in the fourth air chamber.

10. The pneumatic nail gun as claimed in claim 9, wherein the lower slidable sleeve valve further provides two air-tight rings between its outer peripheral surface and the inner surface of the gun body, the lower step and an entrance of the main air passage being disposed between the two air-tight rings.

* * * * *